US006986303B2

(12) United States Patent
Remus

(10) Patent No.: US 6,986,303 B2
(45) Date of Patent: Jan. 17, 2006

(54) DISPLACEMENT SHIFT VALVE AND PUMPING APPARATUS AND METHODS USING SUCH A VALVE

(75) Inventor: Duane R. Remus, Perris, CA (US)

(73) Assignee: Reed LLC, Chino, CA (US)

( * ) Notice: Subject to any disclaimer, the term of this patent is extended or adjusted under 35 U.S.C. 154(b) by 81 days.

(21) Appl. No.: 10/620,121

(22) Filed: Jul. 15, 2003

(65) Prior Publication Data

US 2005/0011350 A1 Jan. 20, 2005

(51) Int. Cl.
*F01B 1/00* (2006.01)

(52) U.S. Cl. ..... 91/172; 91/520; 91/536; 417/342; 417/900

(58) Field of Classification Search ..... 91/172, 91/318, 520, 536; 417/342, 900
See application file for complete search history.

(56) References Cited

U.S. PATENT DOCUMENTS 3,327,641 A * 6/1967 Klosterman ..... 417/342
3,358,563 A * 12/1967 Williams ..... 91/318
3,807,706 A 4/1974 Kugle et al.
3,848,810 A 11/1974 Geisler et al.
4,046,166 A 9/1977 Bender
4,106,882 A 8/1978 Sherrod
4,455,921 A * 6/1984 Griesbach ..... 91/520
4,465,441 A 8/1984 Schwing
4,627,328 A 12/1986 Renders
4,706,932 A 11/1987 Yoshida et al.
5,330,327 A 7/1994 Anderson
5,857,490 A 1/1999 Kao
6,299,416 B1 10/2001 Kwag

FOREIGN PATENT DOCUMENTS

DE 3215817 11/1982
DE 4323800 1/1995
RU 2168412 10/2001

* cited by examiner

*Primary Examiner*—F. Daniel Lopez
(74) *Attorney, Agent, or Firm*—Bingham McCutchen LLP

(57) ABSTRACT

Apparatus and methods are provided for pumping concrete using a pumping apparatus including first and second drive cylinders, a valve, and a pump. Fluid is delivered into the cylinders from the pump to reciprocate pistons within the cylinders. Pressure within the cylinders is monitored, and a direction of flow of the fluid is switched based upon the pressure within the cylinders. For example, during rod-side operation, the valve is set to deliver fluid into a head side of the cylinders. When the pressure exceeds a predetermined threshold, the valve switches to head-side operation, and fluid is delivered into a rod side of the cylinders. If the pressure falls below the threshold, the valve switches the cylinders back to rod-side operation.

15 Claims, 5 Drawing Sheets

DISPLACEMENT SHIFT VALVE AND PUMPING APPARATUS AND METHODS USING SUCH A VALVE

FIELD OF THE INVENTION

The present invention relates generally to apparatus and methods for pumping bulk materials, such as concrete, and more particularly, to valves for switching pumping devices between different operating configurations and apparatus and methods for pumping flowable materials using such valves.

BACKGROUND

Apparatus for pumping concrete and other bulk materials are well known. For example, U.S. Pat. No. 6,299,416 to Kwag discloses a pump device that includes a pair of hydraulic drive cylinders. Each cylinder includes an axial bore and a drive piston coupled to a piston rod that is able to slide within the respective bore, thereby dividing the bore into a head chamber and a base chamber. Fluid lines connect the base chamber of each cylinder to an oil pump and the head chambers of the cylinders to each other.

Oil is pumped in one direction from the pump into the base chamber of a first of the cylinders, thereby retracting the first piston and rod into the first cylinder. This causes oil to be pushed out of the first cylinder's head chamber, through a fluid line into the head chamber of the second cylinder, thereby advancing the second piston and rod outwardly from the second cylinder. Oil in the base chamber of the second cylinder is returned to the pump as the second piston and rod are advanced from the second cylinder.

The pump is then reversed, thereby pumping oil into the base chamber of the second cylinder to retract the second piston and rod this causes the oil in the head chamber of the second cylinder to be transferred into the head chamber of the first cylinder, thereby advancing the first piston and rod, and returning oil in the base chamber of the first cylinder to the pump. The Kwag patent explains that this reciprocating process may be repeated to drive cylinders or other mechanisms to pump concrete from a hopper into a conduit for delivery to a location where the concrete is to be poured.

This method of alternately pumping fluid into the base chambers of a pair of cooperating hydraulic cylinders is known as "rod side operation." Such arrangements are often used when it is desired to deliver relative high volumes of concrete or other materials at relative low pressures.

In addition, pumping devices designed for "head side operation" are also known. These systems alternately pump fluid into the head chambers of a pair of hydraulic cylinders with the base chambers being connected together by a fluid line. Head side operation is generally used to pump relatively lower volumes at higher pressures.

Accordingly, apparatus and methods for pumping concrete and other flowable materials would be useful.

SUMMARY OF THE INVENTION

The present invention is directed to apparatus and methods for pumping flowable materials, such as concrete, and more particularly, to valves for switching pumping devices between different operating configurations and to apparatus and methods for pumping flowable materials using such valves.

In accordance with one aspect of the present invention, an apparatus for pumping flowable material is provided that includes a first barrel, a first piston slidable within the first barrel, thereby dividing the first barrel into a first head-side chamber and a first rod-side chamber, a second barrel, a second piston slidable within the second barrel, thereby dividing the second barrel into a second head-side chamber and a second rod-side chamber, and a pump for delivering fluid to the first and second barrels.

A valve is provided that is movable between a first position wherein the pump communicates with the rod-side chambers, and a second position wherein the pump communicates with the head-side chambers. Preferably, the valve includes passages therein such that the first head-side chamber communicates with the second head-side chamber in the first position, and the first rod-side chamber communicates with the second rod-side chamber in the second position.

In one embodiment, the valve may include ports in the first and second barrels communicating with the first head-side chamber, second head-side chamber, first rod-side chamber, and second rod-side chamber, respectively. The valve may include one or more transfer passages that connect the first head-side chamber port to the second head-side chamber port in the first position, and connect the first rod-side chamber port to the second rod-side chamber port in the second position.

Optionally, one or more sensors may be provided for measuring pressure of the system, e.g., in the supply line from the pump or within at least one of the first and second barrels. A controller may be coupled to the valve and the one or more sensors for moving the valve between the first and second positions based upon pressure measured by the one or more sensors. For example, the controller may be configured fork moving the valve to the first position when the pressure falls below a first threshold, and to the second position when the pressure rises above below a second threshold, which may be the same or different than the first threshold.

In accordance with another aspect of the present invention, a method is provided for pumping flowable material using a pumping apparatus including first and second drive cylinders. Fluid may be delivered into the cylinders to reciprocate pistons within the cylinders, e.g., from a pump. Pressure within the system, e.g., within at least one of the cylinders, may be monitored, and a direction of flow of the fluid may be switched between at least first and second configurations based upon the pressure.

For example, in the first configuration, fluid may be delivered into a rod side of the cylinders when the pressure within at least one of the cylinders is below a predetermined pressure threshold. In the second configuration, fluid may be delivered into a head side of the cylinders when the pressure within at least one of the cylinders exceeds the predetermined pressure threshold or some other threshold. In addition, fluid may be transferred between the head sides of the cylinders in the first configuration, and between the rod sides of the cylinders in the second configuration.

Preferably, fluid is delivered alternately between the first and second cylinders such that the piston within the first cylinder is advanced when the piston within the second cylinder is retracted, and the piston within the first cylinder is retracted when the piston within the second cylinder is advanced. Rods may be connected to the pistons such that the rods provide power to pump a flowable material, such as concrete. Thus, fluid may be delivered using either rod-side operation, e.g., for low pressure, high volume output, or head-side operation, e.g., for high pressure, low volume output.

Other objects and features of the present invention will become apparent from consideration of the following description taken in conjunction with the accompanying drawings.

DETAILED DESCRIPTION OF THE PREFERRED EMBODIMENTS

Turning to the drawings, FIGS. 1A–3 show a preferred embodiment of an apparatus 10 for pumping concrete or other flowable material, in accordance with the present invention. Generally, the apparatus 10 includes first and second drive cylinders 12, 32, a pump 50 for delivering fluid to the cylinders 12, 32, and a valve 60 for controlling the path of fluid flow between the cylinders 12, 32 and the pump 50.

Optionally, the apparatus 10 may include other components, e.g., pumping cylinders or other mechanisms (not shown) coupled to the drive cylinders 12, 32 such that the drive cylinders 12, 32 may provide power to pump concrete or other flowable materials. In addition, the apparatus 10 may include a hopper or other container (not shown) for holding the material being pumped. Furthermore, a frame or other support structure (not shown) may be provided for supporting one or more of the components of the apparatus 10. The frame may be stationary or may be included on a trailer or vehicle, as is well known to those skilled in the art.

Figure 3:
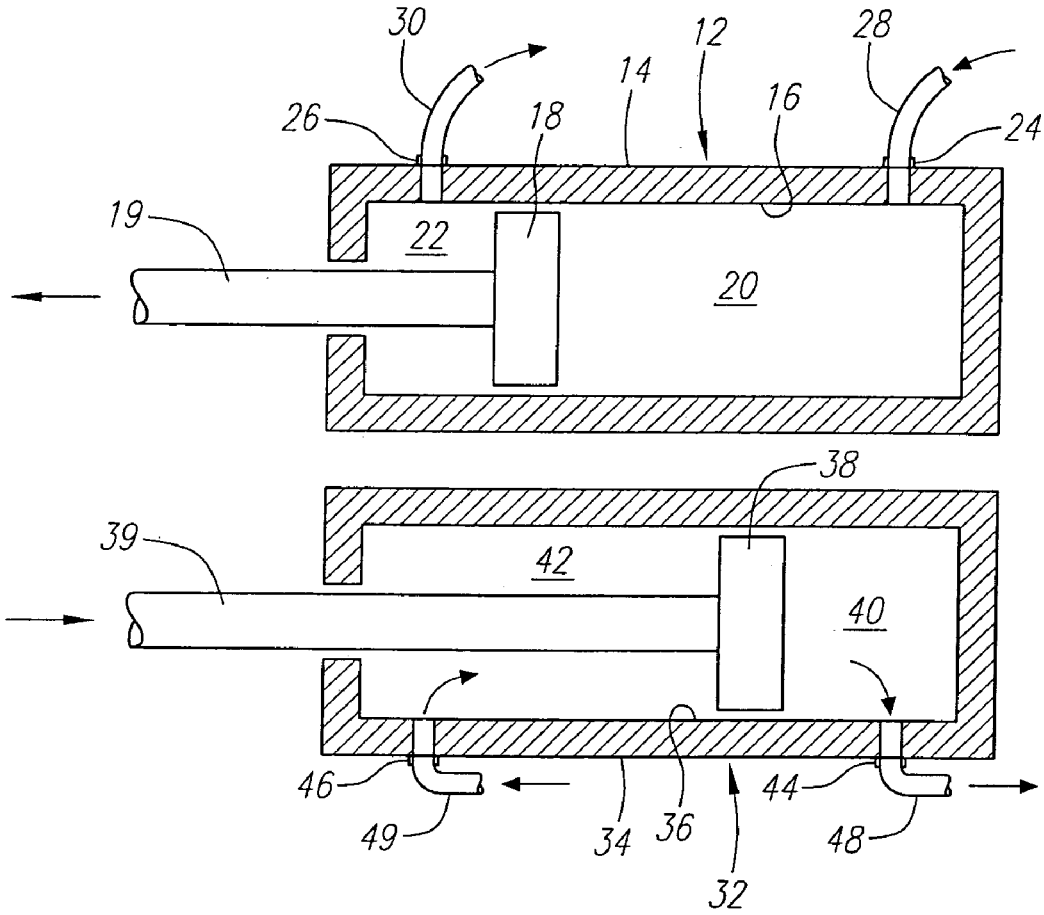
FIG. 3 is a cross-sectional side view of the drive cylinders of the pumping apparatus of FIGS. 2A and 2B.

With particular reference to FIG. 3, each of the first and second drive cylinders 12, 32 includes a barrel 14, 34 having an axial bore 16, 36 therein, and a piston 18, 38 dividing the bore 16, 36 into a head-side chamber 20, 40 and a rod-side chamber 22, 42. Each piston 18, 38 is slidable within the respective barrel 14, 34 for increasing and decreasing a volume of the head-side chamber 20, 30 and rod-side chamber 22, 42 inversely proportional to one another as the piston 18, 38 reciprocates within the barrel 14, 34, as is well known to those skilled in the art. Each piston 18, 38 is connected to a rod 19, 39 for providing an output from the apparatus 10 for driving other components (not shown), e.g., for pumping material.

One or more sensors may be provided for monitoring pressure within the apparatus 10, e.g., within the drive cylinders 12, 32. Preferably, a pressure sensor 100 is provided that is coupled to the output of the pump 50, as explained further below. Alternatively, a pressure sensor (not shown) may be provided in each end of the cylinders 12, 32 such that the pressure within the head-side chambers 20, 40 and/or rod-side chambers 22, 42 may be measured independently and/or simultaneously. In a further alternative, sensors (not shown) may be provided on or adjacent the pistons 18, 38 and/or rods 19, 39 for measuring an output of the apparatus 10, e.g., force or power.

At least two ports 24, 44 are provided in the cylinders 12, 32 that communicate with the head-side chambers 20, 40, respectively. Similarly, at least two ports 26, 46 are provided that communicate with the rod-side chambers 22, 42, respectively. The locations of the ports 24, 26, 44, 46 shown in FIG. 3 are merely exemplary, and may be provided elsewhere in the cylinders 12, 32. Fluid lines 28, 30, 48, 49 extend from the ports 24, 26, 44, 46 to the valve 60, as explained further below. The lines 28, 30, 48, 49 may be formed from conventional hoses, tubing, and the like capable of operating under the pressures normally encountered during operation of high pressure pumping apparatus and are substantially corrosion-resistant to the fluid passing through, the lines 28, 30, 48, 49. The ports and or lines may include conventional connectors (not shown) for substantially permanently or removably securing the lines to the respective ports.

Optionally, the cylinders 12, 32 may include other components known in the art that are not important to the present invention. For example, one or more bypass lines (not shown) may be provided adjacent to the ends of the cylinders 12, 32 for braking the pistons 18, 38 as they approach the ends of their strokes. Additional information on drive cylinders or pumping system components that may be appropriate for use with the present invention are found in U.S. Pat. No. 6,299,416, the disclosure of which is expressly incorporated herein by reference.

Returning to FIGS. 2A and 2B, the pump 50 includes a pumping device 52, e.g., including a motor (not shown) and the like, and may be any conventional pumping device capable of generating the pressures and volumetric flow rates appropriate for driving the cylinders 12, 32. Preferably, the pump 50 includes an outlet line 56 for delivering fluid, generally substantially incompressible fluids, such as oil, at desired pressures and flow rates. In addition, the pump 50 includes an inlet line 58, which may include a collection pan or other container 59 for collecting fluid returned from the cylinders 12, 32. The outlet 56 and inlet 58 are connected by lines 72, 74 to the valve 60, which may transfer the fluid to the cylinders 12, 32, as explained further below. The pump 50 may include a valve or other switching mechanism 54 for reversing flow from the pump 50, i.e., such that during alternate cycles, the lines 72, 74 may supply fluid to and/or return fluid from the cylinders 12, 32, as explained further below. Alternatively, the pump 50 may be a reversible pump that may pump fluid alternately in one direction and in an opposite direction (i.e., such that the outlet 56 and inlet 58 alternate).

The pump 50 may include one or more sensors 100 for measuring pressure within the apparatus 10, e.g., within the outlet line 56 and/or the inlet line 58. The pressure measured by the sensor(s) 100 may be substantially proportional to the pressure within the cylinder(s) 12, 32, thereby providing an indication of the load being imposed on the apparatus 10.

Figure 1A:
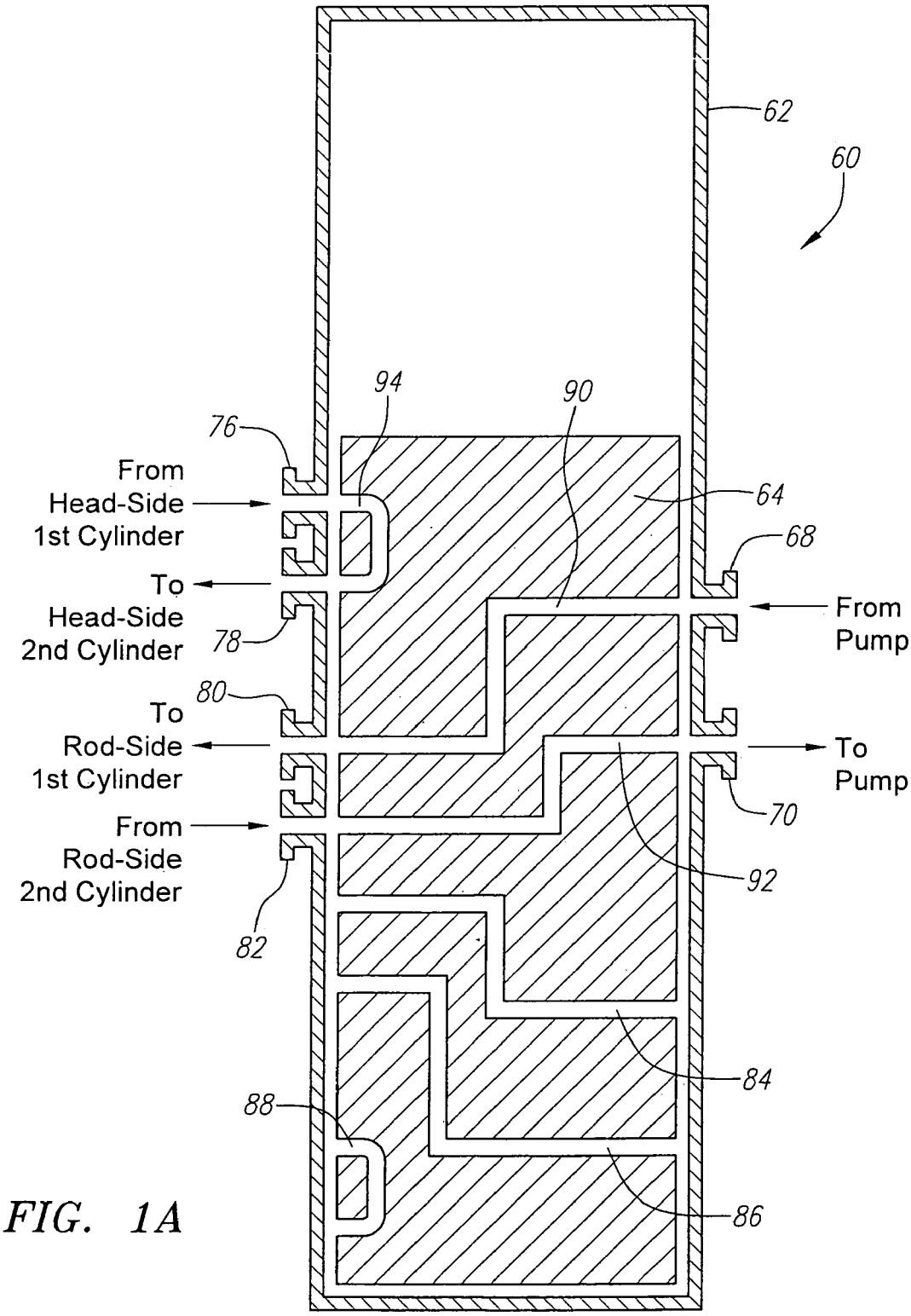
FIGS. 1A and 1B are cross-sectional side views of a displacement shift valve, in accordance with the present invention.
Figure 1B:
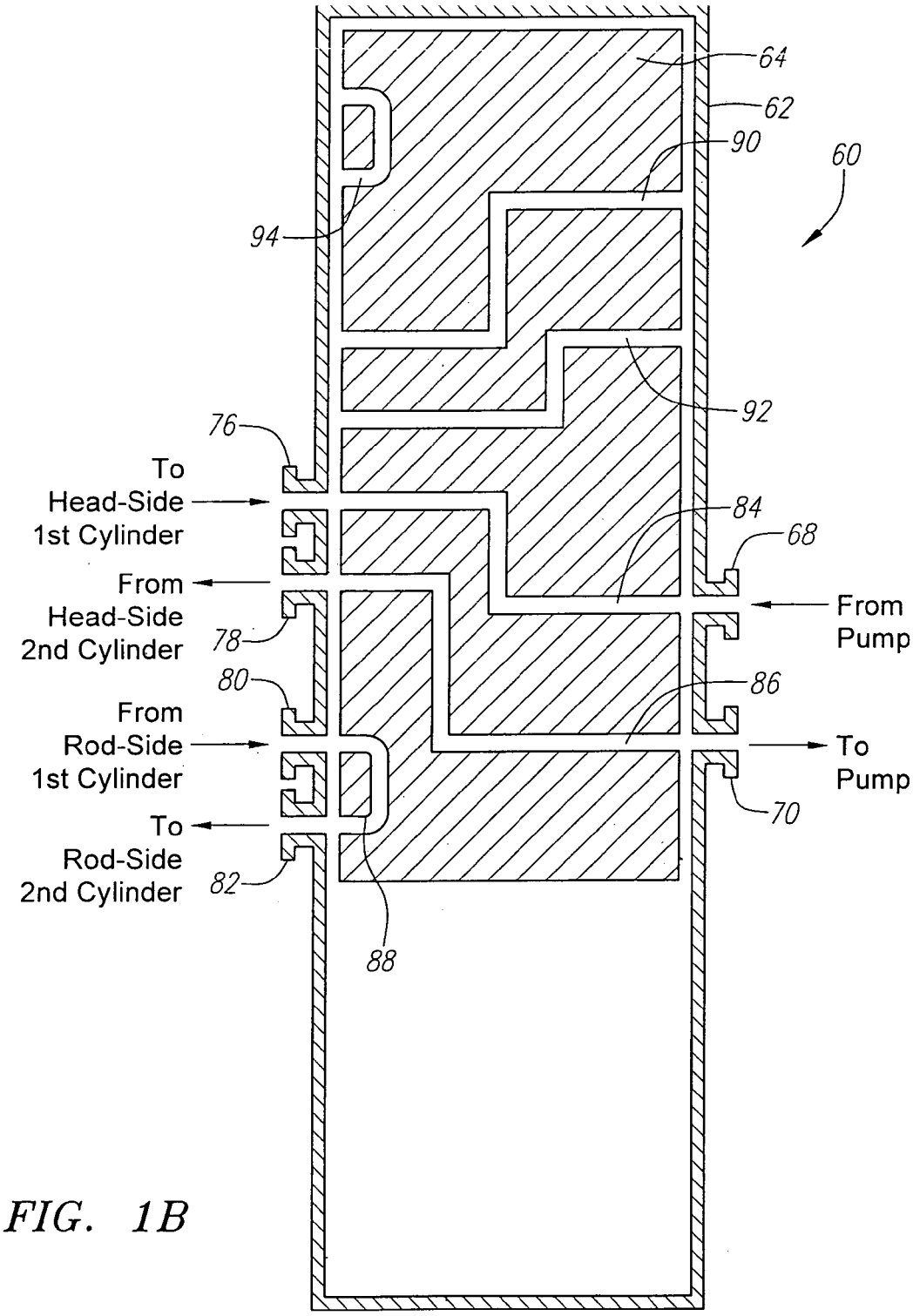

Turning to FIGS. 1A and 1B, the valve 60 generally includes a housing 62, and a body 64 movably mounted within the housing 62. Although a single housing 62 is shown, it will be appreciated by those skilled in the art that the valve 60 may include multiple housings and/or manifolds connected to one another (directly or by various fluid lines). In addition or alternatively, the housing(s) may include multiple internal parts (not shown) instead of the single body shown that may move in a desired manner to create the desired passages through the valve, as described further below. The configuration of the passages within the valve 60 is merely exemplary, and may be modified based upon desired physical geometry and/or performance criteria, as is well known to those skilled in the art.

Figure 2A:
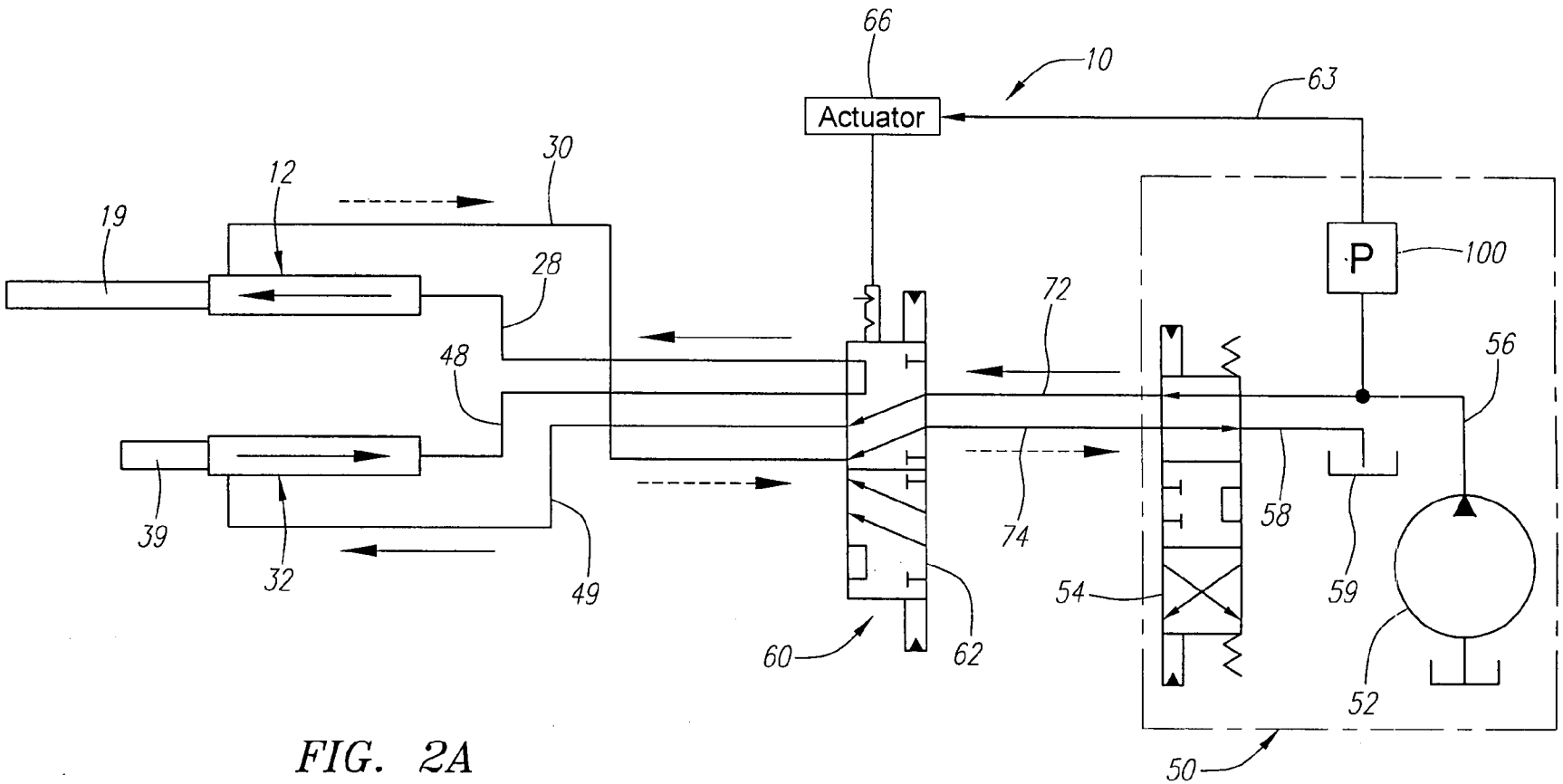
FIG. 2A is a schematic of a pumping apparatus including a valve, such as the valve of FIGS. 1A and 1B, with the valve positioned for rod-side operation.
Figure 2B:
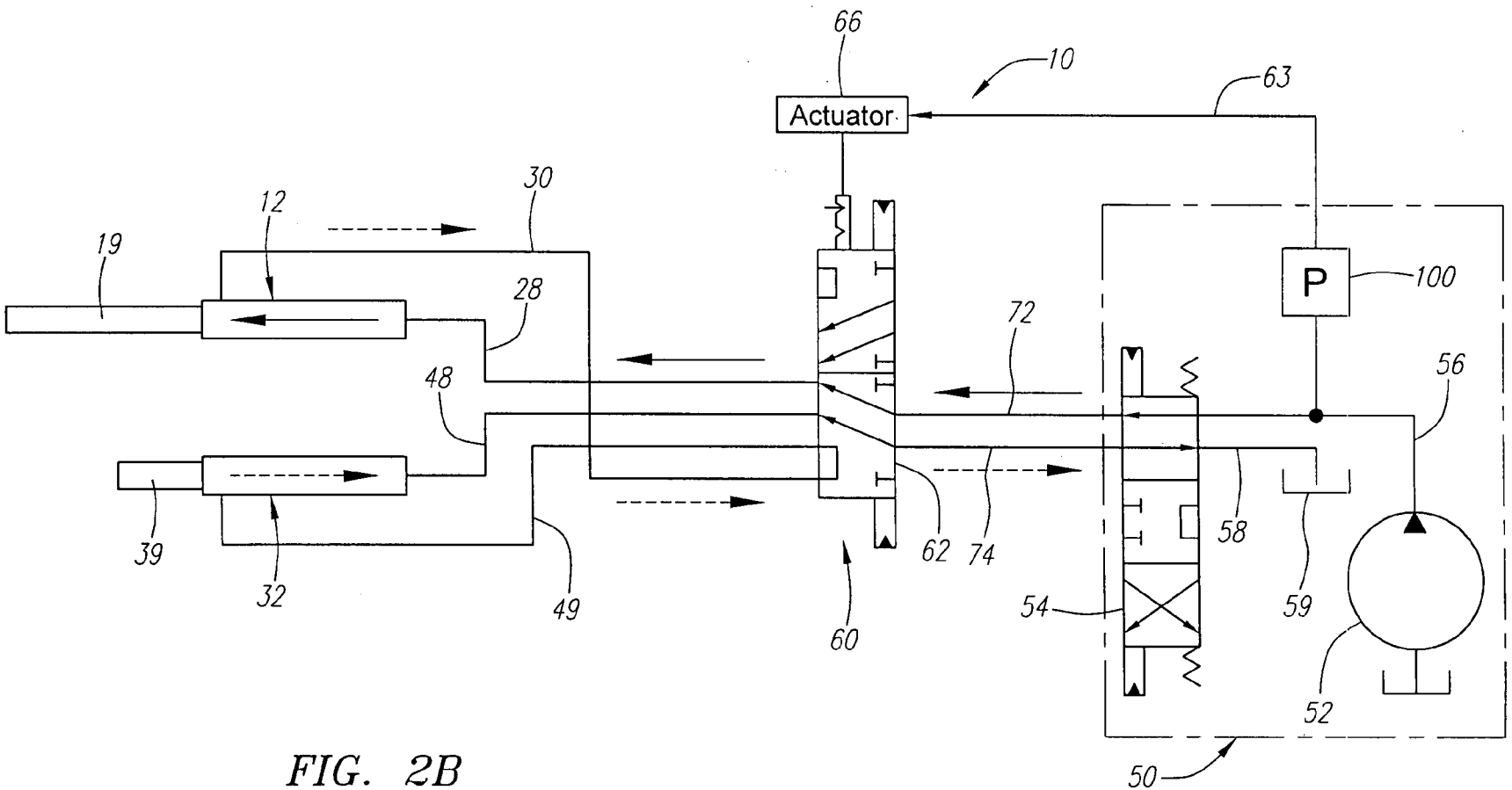
FIG. 2B is a schematic of the pumping apparatus of FIG. 2A, with the valve positioned for head-side operation.

In addition as shown in FIGS. 2A and 2B, an actuator 66 may be coupled to the valve 60 for moving the body 64 within the housing 62 (not shown in FIGS. 2A and 2B). The actuator 66 may include any controller or system that may move the body 64 (or other components of the valve 60) to one or more positions within the housing 62. For example, the actuator 66 may include a motor, magnet, or other device (not shown) that may be coupled mechanically, magnetically, or otherwise to the valve 60 for selectively moving the body 64 within the housing 62. In one embodiment, the body 64 may be biased to a first position, e.g., by one or more springs, and the actuator 66 may overcome the bias to move the body 64 to a second (or additional) position. Thus, when the actuator 66 is deactivated, the body 64 may automatically return to the first position. In a preferred embodiment, the valve 60 may be a spring return valve biased to the first position, i.e., for "rod-side operation," as explained further below.

The actuator 66 may include a processor or other circuitry that may be coupled via a communication line 63 to the pressure sensor(s) 100 within the pump 50 for acquiring pressure data and moving the body 64 in response to data measured by the sensor(s) 100, as discussed further below. Alternatively, the actuator 66 may be coupled to other sensors (not shown) for monitoring other parameters of the cylinders 12, 32 or elsewhere in the apparatus 10. For example, power of force output by the cylinders 12, 32 may be monitored in addition to or instead of pressure, and the actuator 66 may move the body 64 based upon the monitored parameter(s).

Returning to FIGS. 1A and 1B, the valve 60 generally includes a plurality of passages extending therethrough for delivering fluid between the pump 50 and the cylinders 12, 32 In addition, the valve 60 may include one or more transfer passages for transferring fluid between the cylinders 12, 32 The valve 60 may include a number of seals and the like (not shown) for substantially sealing the passages from one another and/or otherwise preventing substantial leakage, as is well known to those skilled in the art.

For, example, as shown in FIGS, 1A–2B, the housing, 62 may include pump ports 68, 70 that may be connected to the pump 50 by fluid lines 72, 74. The pump ports 68, 70 and/or fluid lines 72, 74 may include connectors, e.g., including flanges, bolts, and the like, for attaching the fluid lines 72, 74 to the ports 68, 70, similar to the fluid lines connected to the ports of the drive cylinders 12, 32 discussed above. Ports 76, 78, 80, 82 may be provided that may be connected to the ports 24, 44, 26, 46 in the drive cylinders 12, 32 via the fluid lines 28, 48, 30, 49.

The body 64 may include passages that extend between the pump ports 68, 70 and ports 76, 78, 80, 82 when the body 64 is in one or more positions within the housing 62. In addition, the body 64 may include one or more transfer passages that may be used to connect the drive cylinders 12, 32 to one another. For example, as shown in FIG. 1A, in a first position, passages extend between pump ports 68, 70 and ports 80, 82, respectively. In the first position, transfer passage 94 connects ports 76, 78 to one another. In a second position, shown in FIG. 1B, passages 84, 86 extend between pump ports 68, 70 and ports 76, 78, and transfer passage 88 connects ports 80, 82 to one another.

Thus, with reference to FIGS. 1A, 2A, and 3, when the valve 60 is in the first position, the apparatus 10 is configured for "rod-side operation." During rod-side operation, fluid from the pump 50 may be delivered through the lines 72, 74, the passages 90, 92 within the valve 60, and the lines 30, 49 into the rod-side chambers 22, 42 see FIG. 3) of the cylinders 12, 32. Rod-side operation may be preferred in situations in which the apparatus 10 requires relatively high volumes of material to be delivered at relatively low pressures.

The actuator 66 may receive pressure data from the sensor(s) 100, e.g., to monitor pressure output by the pump 50, within outlet and/or inlet lines 56, 58, and/or within the rod-side chambers 22, 42. If the pressure rises above a predetermined threshold, the actuator 66 may move the body 64 to the second position, i.e., to shift the apparatus 10 from rod-side to head-side operation.

With the valve 60 in the second position, shown in FIGS. 1B and 2B, the apparatus 10 is configured for "head-side operation." Head-side operation may be preferred in situations in which the apparatus 10 may experience relatively high pressures, e.g., between about 2,500–3,200 pounds per square inch (psi), and preferably above about three thousand pounds per square inch (3,000 psi). Consequently, relatively low volumes may be pumped at relatively high pressures using head-side operation.

During head-side operation, fluid from the pump 50 may be delivered from the outlet 56 and/or inlet 58, through the lines 72, 74, the passages 84, 86 within the valve 60, and the lines 28, 48 into the head-side chambers 20, 40 see FIG. 3) of the drive cylinders 12, 32. If fluid is delivered into the head-side chamber 20 of the first cylinder 12, i.e., through the port 24, the piston 18 may be pushed away from the head-side chamber 20, thereby advancing the rod 19 out of the first cylinder 12. This action pushes fluid out of the rod-side chamber 22 of the first cylinder 12, i.e., out the port 26, through the line 30, the transfer passage 88, the line 49, and into the rod-side chamber 42 of the second cylinder 32 via the port 46. As fluid enters the rod-side chamber 42, the piston 38 is pushed away from the rod-side chamber 42, thereby retracting the rod 39 into the second cylinder 32. This causes fluid to exit the head-side chamber 40 via the port 44, and pass through the line 48, the passage 86, the line 74 to the inlet 58 and into the pump 50.

Once the pistons 18, 38 reach the end of their strokes (which may be monitored using conventional devices and methods), the output of the pump 50 is reversed, i.e., delivering fluid into the head-side chamber 40 of the second cylinder 32, thereby advancing the rod 39 out of the second cylinder 32. This transfers fluid from the rod-side chamber 42 through the transfer passage 88 into the rod-side chamber 22 of the first cylinder 12, causing the rod 19 to retract into the first cylinder 12. Fluid is then returned to the pump 50 through the line 28, passage 84, and line 72.

If the pressure within the drive cylinders 12, 32 falls below a predetermined threshold, e.g., between about 2,500–3,200 psi, and preferably below about three thousand pounds per square inch (3,000 psi), the actuator 66 may return the valve 60 to the first position. For example, the actuator 66 may receive pressure data from the sensor(s) 100, and monitor the pressure relative to the predetermined threshold, which may be set manually or automatically. Once the pressure falls below the threshold, the valve 60 may be switched to the first position.

Thus, the apparatus and methods of the present invention may provide a more versatile pumping apparatus. The output from the apparatus may be used to drive a system for delivering concrete or other flowable material, such as food products, plastics, and the like (not shown). Unlike conventional systems, the systems and methods of the present invention are capable of automatically switching between high pressure/low volume and low pressure/high volume outputs, as needed during a particular application.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

What is claimed is:

1. An apparatus for pumping flowable material, comprising:

a first barrel;

a first piston movable within the first barrel, thereby dividing the first barrel into a first head-side chamber and a first rod-side chamber;

a second barrel;

a second piston movable within the second barrel, thereby dividing the second barrel into a second head-side chamber and a second rod-side chamber;

a pump for delivering fluid to the first and second barrels;

a valve fluidly coupled between the pump and the first and second barrels, the valve movable between a first position wherein an outlet of the pump alternately communicates with the first and second rod-side chambers, and a second position wherein the outlet of the pump alternately communicates with the first and second head-side chambers;

one or more sensors for measuring a parameter related to the fluid delivered by the pump to the first and second barrels; and a controller coupled to the valve and the one or more sensors, the controller moving the valve between the first and second positions based upon the measured parameter.

2. The apparatus of claim 1, wherein the valve comprises passages therein such that the first head-side chamber communicates with the second head-side chamber in the first position, and the first rod-side chamber communicates with the second rod-side chamber in the second position.

3. The apparatus of claim 1, wherein the pump comprises an inlet for removing fluid from the first and second barrels, the pump and valve collectively configured for alternately connecting the inlet to the first and second rod-side chambers when the valve is in the first position, and alternately connecting the inlet to the first and second head-side chambers when the valve is in the second position.

4. The apparatus of claim 1, wherein the one or more sensors comprise one or more sensors for measuring fluid pressure.

5. The apparatus of claim 4, wherein the controller is configured for moving the valve to the first position when the pressure rises above a first predetermined threshold, and to the second position when the pressure falls below a second predetermined threshold.

6. The apparatus of claim 5, wherein the second predetermined threshold substantially equals the first predetermined threshold.

7. An apparatus for pumping concrete or other flowable material, comprising:

a first barrel;

a first piston dividing the first barrel into a first head-side chamber and a first rod-side chamber, the first piston being movable within the first barrel for increasing and decreasing a volume of the first head-side and rod-side chambers; a second barrel;

a second piston dividing the second barrel into a second head-side chamber and a second rod-side chamber, the second piston being movable within the second barrel for increasing and decreasing a volume of the second head-side and rod-side chambers;

a pump comprising an outlet for delivering fluid to the first and second barrels, and a inlet for removing fluid from the first and second barrels;

a valve fluidly coupled between the pump and the first and second chambers, the valve movable between first and second positions, wherein, in the first position, the outlet of the pump alternately communicates with the first and second rod-side chambers, while the first head-side chamber communicates with the second head-side chamber, and, in the second position, the outlet of the pump alternately communicates with the first and second head-side chambers, while the first rod-side chamber communicates with the second rod-side chamber;

one or more sensors for measuring pressure of the fluid delivered by the pump to the first and second barrels; and a controller coupled to the valve and the one or more sensors, the controller moving the valve between the first and second positions based upon the measured pressure.

8. The apparatus of claim 7, further comprising a first rod coupled to the first piston and extending through the first rod-side chamber, the first rod being movable as the first piston reciprocates within the first barrel, and a second rod coupled to the second piston and extending through the second rod-side chamber, the second rod being movable as the second piston reciprocates within the second barrel.

9. The apparatus of claim 8, further comprising pump cylinders coupled to the first and second rods, the pump cylinders being movable by the first and second rods for pumping concrete or other flowable material using the pump cylinders.

10. The apparatus of claim 7, wherein the controller is configured for moving the valve to the first position when the pressure rises above a first predetermined threshold, and to the second position when the pressure falls below a second predetermined threshold.

11. A method for pumping flowable material using a pumping apparatus comprising first and second drive cylinders, the method comprising:

delivering fluid into the cylinders to reciprocate pistons within the cylinders, the respective piston dividing the respective cylinder into a rod side and a head side;

monitoring pressure within the pumping apparatus; and switching a direction of flow of the fluid between at least first and second configurations, wherein the first configuration comprises delivering fluid into the rod sides of the cylinders when the pressure within at least one of the cylinders is below a predetermined pressure threshold, and the second configuration comprises delivering fluid into the head sides of the cylinders when the pressure within at least one of the cylinders exceeds the predetermined pressure threshold.

12. The method of claim 11, wherein fluid is transferred between the head sides of the cylinders in the first configuration, and wherein fluid is transferred between the rod sides of the cylinders in the first configuration.

13. The method of claim 11, wherein the fluid is delivered alternately between the first and second cylinders such that the piston within the first cylinder is advanced when the piston within the second cylinder is retracted, and the piston within the first cylinder is retracted when the piston within the second cylinder is advanced.

14. The method of claim 11, wherein rods are connected to the pistons, and wherein the rods provide power to pump the flowable material.

15. The method of claim 11, wherein the flowable material comprises concrete.

* * * * *